US005820520A

United States Patent [19]

Sieber

[11] Patent Number: 5,820,520

[45] Date of Patent: Oct. 13, 1998

[54] EXERCISE DEVICE

[76] Inventor: Walter Paul Sieber, 21 Snyder Ave. N. #7, Elmira, Ontario, Canada, N3B 2B2

[21] Appl. No.: 584,205

[22] Filed: Jan. 4, 1996

[51] Int. Cl.[6] ..... A63B 21/04

[52] U.S. Cl. ..... 482/34; 482/148

[58] Field of Search ..... 482/34, 37, 38, 482/95, 96, 904, 148

[56] References Cited

U.S. PATENT DOCUMENTS

| | | | |
|---|---|---|---|
| D. 182,660 | 4/1958 | Hastings . | |
| D. 209,759 | 1/1968 | Snyder . | |
| D. 292,427 | 10/1987 | Baburek . | |
| 1,969,165 | 8/1934 | Turner . | |
| 2,643,123 | 6/1953 | Spinks . | |
| 2,832,595 | 4/1958 | Hastings . | |
| 2,906,532 | 9/1959 | Echols | 482/146 |
| 2,921,791 | 1/1960 | Berne . | |
| 3,068,003 | 12/1962 | Portman . | |
| 3,228,683 | 1/1966 | Leteff | 482/148 |
| 3,428,311 | 2/1969 | Mitchell . | |
| 3,587,319 | 6/1971 | Andrews . | |
| 3,724,450 | 4/1973 | Chaitin | 482/904 |
| 3,957,266 | 5/1976 | Rice . | |
| 4,036,490 | 7/1977 | Rice . | |
| 4,243,219 | 1/1981 | Price | 482/904 |
| 4,313,603 | 2/1982 | Simjian . | |
| 4,517,966 | 5/1985 | von Othegraven | 128/75 |
| 4,834,364 | 5/1989 | Gongwer et al. . | |
| 4,925,185 | 5/1990 | Gongwer et al. . | |

FOREIGN PATENT DOCUMENTS

| | | | |
|---|---|---|---|
| 0215467 | 9/1986 | European Pat. Off. | 482/121 |
| 0 215 467 | 3/1987 | European Pat. Off. . | |

*Primary Examiner*—Stephen R. Crow
*Attorney, Agent, or Firm*—Riches, McKenzie & Herbert

[57] ABSTRACT

The present invention discloses an exercise apparatus which includes a gripping or handle assembly which is grasped at each of its ends by a user's hands. The handle assembly is rotatably mounted on a support having a configuration selected so that when the ends of the handle assembly are grasped by the user, the user is in a position with his hands positioned above his shoulders. The handle is then rotated by the user pulling on one end of the assembly and then the other end, to pivot the handle assembly about a pivot point and stretch the various upper body muscles.

19 Claims, 4 Drawing Sheets

FIG. 5.
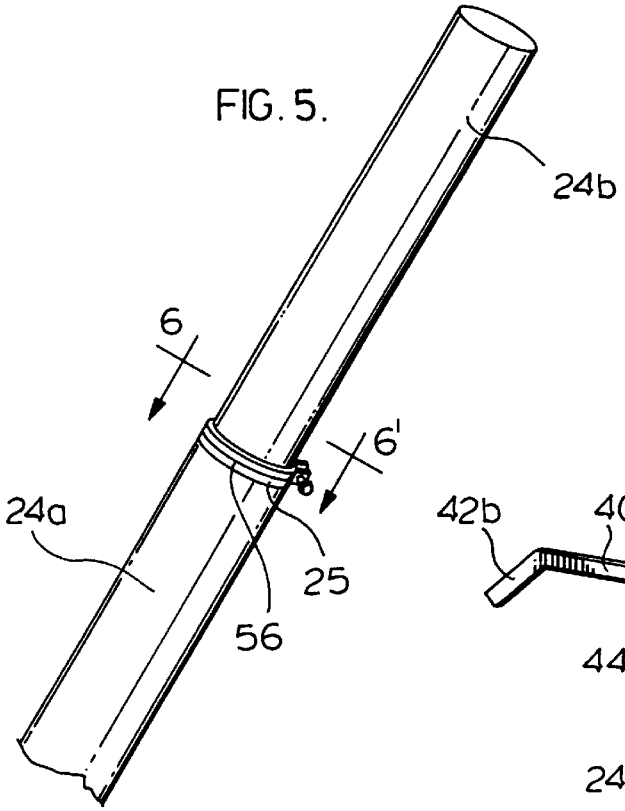
FIG. 6.
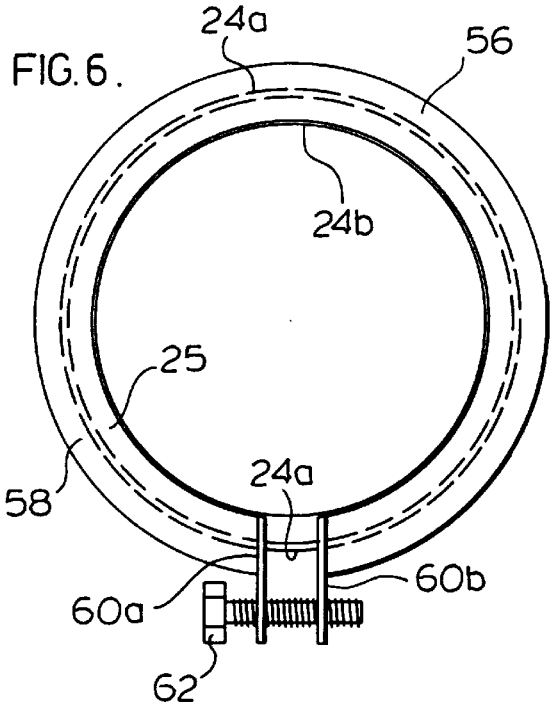
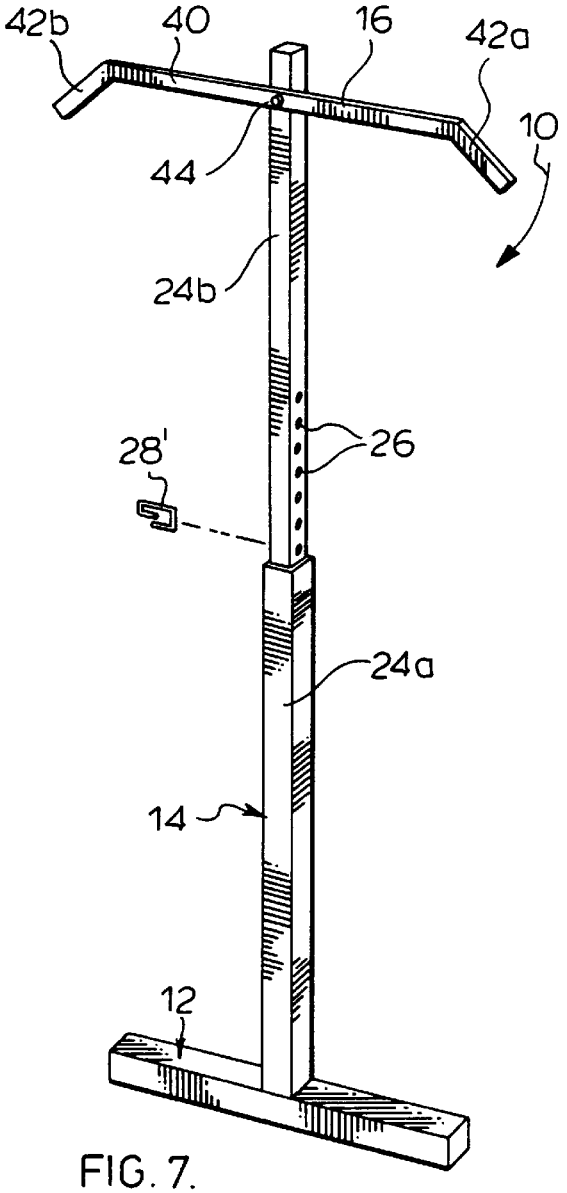
FIG. 7.

EXERCISE DEVICE

SCOPE OF THE INVENTION

The present invention is directed to an exercise device, and more particularly an exercise device for exercising and stretching the muscles of a user's upper body and torso.

BACKGROUND OF THE INVENTION

Various apparatus for exercising and stretching an individual's upper body are known. Heretofore, however, such exercise devices have largely been ineffective in providing the user with a sufficient range of movements necessary to provide a complete upper body workout.

U.S. Pat. No. Des. 182,660 to Hastings discloses one such upper body exercise device which incorporates a rope joining a pair of handles, strung together over a pulley. In its use, as one handle is pulled, the user's other arm is out-stretched towards the pulley. While the Hastings apparatus may be effective in stretching the user's bicep muscles, the apparatus is not effective in stretching or exercising other muscle groups of the user's torso and upper body.

An exercising apparatus having expanded muscle group exercising capabilities is disclosed in U.S. Pat. Nos. 3,957,266 and 4,036,190 each to Rice. The Rice exercising apparatus operates by the user exerting a downward or upward pressure on a pole. These exercise devices suffer the disadvantage in that while it may be useful in providing resistive forces for exercising various muscle groups, the muscle stretching capabilities of the exercising apparatus are limited.

SUMMARY OF THE INVENTION

Accordingly, it is an object of the present invention to at least partially overcome the disadvantages of the prior art by providing an exercise apparatus for exercising and stretching a user's upper body or torso, and which incorporates a handle bar which may be gripped and rotated by a user in an outstretched position to stretch and exercise various muscle groups.

Another object of the invention is to provide an exercising and stretching device (collectively referred to as exercise) adapted to exercise a user's back, shoulder and intrinsic and extrinsic muscles, such as the user's trapezius, latissimus dorsi, petoralis major, petoralis minor, deltoid, teres minor, teres major and external intercostal muscles.

Another object of the invention is to provide an exercise apparatus having a simplified construction for ease of manufacture.

A further object of the invention is to provide an apparatus which in addition to exercising a user's upper body, also enables exercise of one or more of the user's leg muscles, tibialis, tibialis posterior, tibialis interior, rectus abdominus and the like.

Another object of the invention is to provide an inexpensive exercise device which may be easily compacted for storage.

In furtherance of the foregoing objects, the invention provides an exercise apparatus which includes a gripping or handle assembly which is grasping at each of its ends by a user's hands. The handle assembly is rotatably mounted on a support and is rotated by the user pulling on one end of the assembly and then the other end, to pivot the handle assembly about a pivot point and stretch the various upper body muscles.

Preferably the support is provided with a configuration selected so that when the ends of the handle assembly are grasped by the user's hands, the user is in a position with his hands positioned above his shoulders, and more preferably in an outstretched position with his hands above the user's head. The handle assembly is rotated by the user exerting a greater pulling force on one end of the handle assembly in a first direction towards the user as compared to the force applied to the second other end. As the pulled end of the handle assembly moves along an arc in a first direction towards the user, the second other end of the handle assembly moves in a second opposite direction away from the user stretching the muscle groups along the user's sides and back.

More preferably, the handle assembly rotates in a plane which is at right angles to the midsagittal plane of the user, and parallel to the frontal or coronal plane of the user's body. By alternately moving each end of the handle assembly in such a plane towards and away from the user, the user may thus effectively exercise and/or stretch the various muscle groups including the Teres minor, Teres major, Trapezius, Latissimus dorsi and other muscles of the upper body.

In one simple construction, resistance to the rotation of the handle assembly is provided by the user applying downward forces simultaneously on both ends of the handle assembly. If desired, however, additional resistance may be provided by incorporating a tension adjusting mechanism into the apparatus. For example, resistance to rotation of the handle assembly may be increased by increasing frictional contact of the handle assembly against the support as it is rotated. The tension adjusting mechanism may simply comprise a bolt which may be turned to tighten or loosen the handle assembly against the support, or alternately, gearing, a friction plate or roller, pulleys or other resistance providing components may be incorporated.

The handle assembly may also be resiliently biased to a rest position under the force of a spring, weight or other such biasing mechanism. With such a construction, improved muscle exercise capabilities are provided as the user would thereby rotates the handle assembly not only against a countering force applied the user, but also against the force supplied by the spring or the like.

Various support constructions are possible, however, a cost effective and easily manufactured apparatus may be achieved by the use of a highly simplified support configuration. For example, one such support which is adapted to support a user'torso resting thereon in an inclined position has a tubular construction in which a lower end rests on the floor and an upper end which is leaned against a wall. With such a construction, the user operates the exercise device in a position inclined against the support with his arms fully outstretched above his head to grasp the ends of the handle assembly.

Accordingly, in one aspect the present invention resides in an exercise apparatus for exercising a user's torso comprising, support means for supporting the user in an inclined position, handle means having first and second ends for gripping by said user, the handle means pivotally coupled to the support means at a pivot point located above said user's torso, and whereby rotational movement of said handle means moves said first end in a first direction along a first arcuate path and said second end in a second substantially opposite direction along a second arcuate path, said first and second arcuate paths each centered on said pivot point.

In another aspect the present invention resides in a floor mounted exercise apparatus for exercising a user's upper body, the apparatus comprising, an elongate body support member having a lower end, an upper end and an inclined upper surface for supporting said user thereon in an inclined position, elongated handle means rotatably coupled to the upper surface at a pivot point spaced towards said upper end, the handle means having a first end and a second opposite end for gripping by said user, each of said first and second ends spaced from said pivot point whereby rotation of said handle means moves said first end in a first direction along a first arcuate path and said second end in a second direction generally opposite to said first direction along a second arcuate path, each of said first and second arcuate paths being centered on said pivot point.

In a further aspect the present invention resides in a use of a floor mounted exercise apparatus for exercising a user's upper body, said apparatus comprising a body support member having a lower end, an upper end extending above said user, and an inclined upper surface for supporting said user therein in a position inclined relative to said floor, elongated handle means having a first end and a second opposite end, the handle means rotatably coupled to the support member at a pivot point spaced towards the upper end so that when said user grasps said first and second ends in said inclined position, said user is in a substantially outstretched position, rotational movement of said handle means moving said first end in a first direction along a first arcuate path and said second end in a second substantially opposite direction along a second arcuate path, said first and second arcuate paths each being centered on said pivot point, whereby with said user resting against said support member in said inclined and substantially outstretched position each of the first and second ends are grasped and said handle means is rotated by first moving said first end in a first direction towards said user and then moving said second end in a second direction towards said user.

BRIEF DESCRIPTION OF THE DRAWINGS

Further objects and advantages of the invention will appear from the following description together with the accompanying drawings in which:

FIG. 5 shows a partial schematic view of a second embodiment of a support for use with the exercise device of FIG. 1;

FIG. 6 shows an enlarged cross-sectional view of the support of FIG. 5 taken along line 6–6'; and FIG. 7 shows a partially exploded perspective view of an exercise device in accordance with another embodiment of the invention.

DETAILED DESCRIPTION OF THE DRAWINGS

Figure 1:
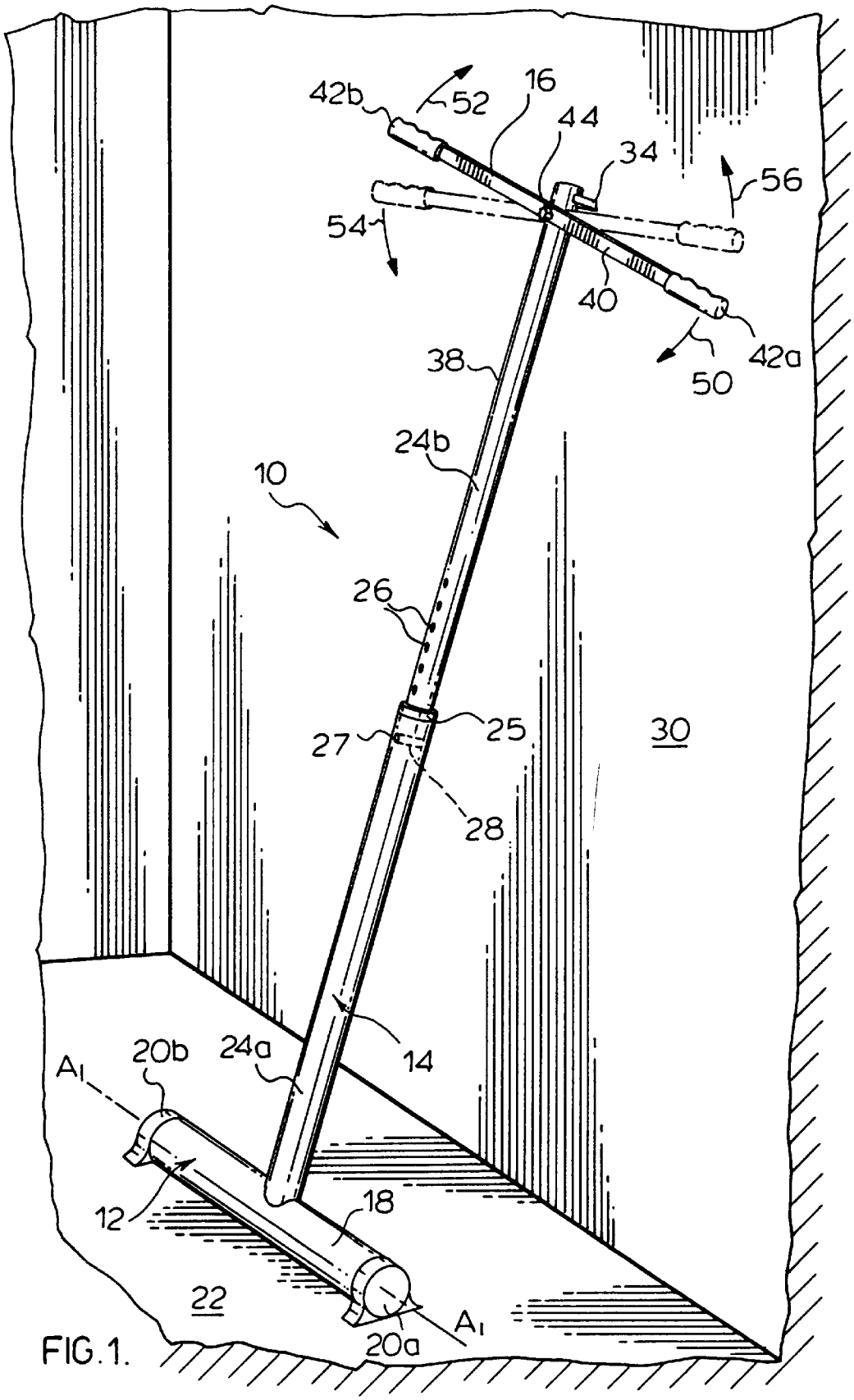
FIG. 1 shows a perspective view of a preferred exercise device in accordance with the present invention.
Figure 2:
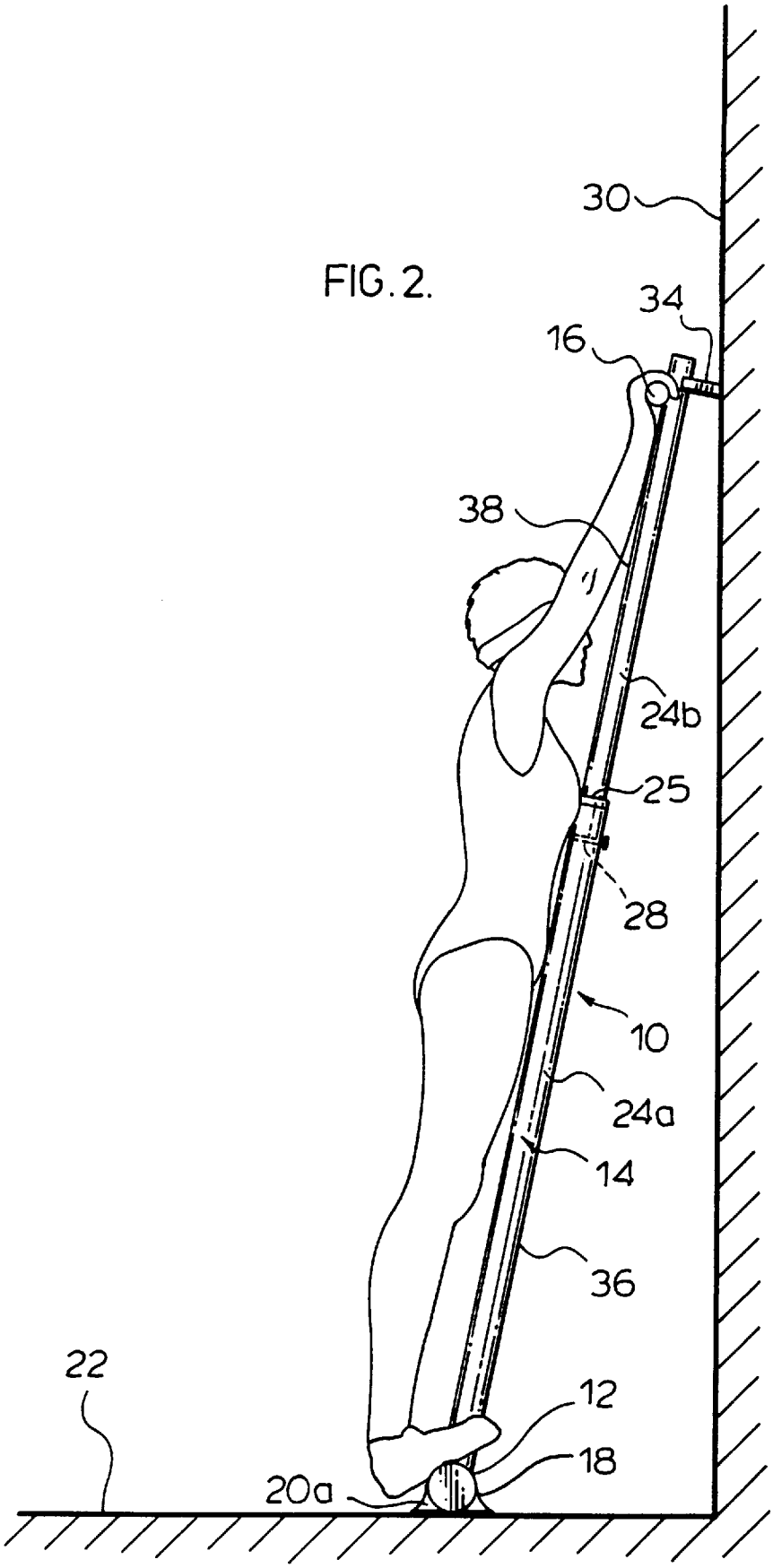
FIG. 2 shows a side view of the exercise device of FIG. 1 with a user thereon.

Reference is made to FIGS. 1 and 2 which show an exercise apparatus generally indicated 10 in accordance with the present invention. The apparatus 10 includes a lower base 12, an elongated support 14 and a handle assembly 16.

The base 12 is formed from a cylindrical metal tube 18 having a radial diameter of between approximately 2 and 6 inches, and an axial length along longitudinal axis $A_1$ of at least 1.5 feet, so as to permit a user to stand thereon. A pair of rubber shoes 20*a*,20*b* are positioned over each end of the tube 18. The shoes 20*a*,20*b* are provided with flattened bottom surfaces which rest upon the floor 22 and act to limit sliding movement of the exercise apparatus 10 when it is in use.

As will be described hereafter, in addition to rotatably supporting the handle assembly 16, the support 14 acts to maintain an individual in the optimum position when using the apparatus 10. The support 14 includes lower and upper hollow steel tubes 24*a*,24*b*, each between approximately three and one-half and four feet in length. The lower support tube 24*a* is formed having a radial diameter which is marginally larger than the radial diameter of the upper support tube 24*b*, and which is preferably between about 2 to 5 inches. The tubes 24*a*,24*b* are slidably attached together with the narrower diameter upper support tube 24*b* telescopingly slid into the upper end of the lower tube 24*a*. A series of equally spaced apertures 26 formed in tube 24*b* and an aperture 27 formed through tube 24*a* enable the tubes 24*a*,24*b* to be fixedly secured in place by aligning one aperture 26 with aperture 27 and inserting a locking bolt 28 therethrough. In addition to permitting the upper tube 24*b* to be slid downwardly within lower tube 24*a* for compact storage of the apparatus 10, the telescoping fit of the tubes 24*a*,24*b* and number of spaced apertures 26 permit the overall height of the apparatus 10 to be adjusted to best suit the height of an individual user.

Although not essential, FIG. 1 shows a hollow plastic sleeve 25 which is slid into the upper end of the tube 24*a*. The sleeve 25 acts as a spacer or bushing to prevent frictional contact of the tube 24*b* against the inside of tube 24*a*.

The lower tube 24*a* is welded directly to the middle portion of the tube 18. The lower tube 24*a* is connected to the tube 18 so that when the base 12 is positioned with the bottom surfaces of the shoes 20*a*,20*b* resting on the floor 22, the support 14 angles upwardly from the base 12 in a direction perpendicular to the longitudinal axis $A_1$ of the tube 18 at an angle of between about 10° and 40° from vertical. With this configuration, the exercise apparatus 10 may be positioned for use with the base 12 resting on the floor 22 and the upper end of the support 14 leaning against a wall 30.

A rubber brace 34 is secured near the uppermost portion of the upper tube 24*b*. The brace 34 extends outwardly from a lower surface 36 of the support 14 which is spaced closest to the wall 30. The brace 34 thus positioned, is configured to engage the wall 30 and assist in maintaining the exercise apparatus 10 in an inclined position, supported by the floor 20 and the wall 30. Although not essential, if desired, the brace 34 may be constructed to maintain the uppermost end of the tube 24*b* a desired spacing from the wall 30. Keeping the upper end of the tube 24*b* spaced outwardly from the wall 30 ensures free movement of a user's arms or hands between the wall 30 and apparatus 10 when rotating the handle assembly 16.

The handle assembly 16 is rotatably secured near the uppermost end of the upper tube 24*b* on an uppermost surface 38 of the support 14 which faces away from and is furthest to the wall 30. The handle assembly 16 shown in FIG. 1 comprises a straight metal bar 40 between one and two feet in length, which is provided with rubber handle grips 42*a*,42*b* over each of its ends. The bar 40 is rotatably coupled to the tube 24*b* by a pin 44 which is inserted through openings formed through both the center of the bar 40 and the upper portion of the tube 24*b*, and which acts as a pivot point about which the handle assembly 16 rotates.

The exercise apparatus 10 is configured to support a user in an inclined position, as for example as shown in FIG. 2, with the base 12 resting on the floor 20, the upper end of the support 14 leaning against the wall 30, and with the upper tube 24*b* coupled to the lower tube 24*a* so that the handle assembly 16 is positioned above the user's shoulders. In this position, the user leans with either his or her back or stomach against the upper surface 38 of the support 14 to assume a position inclined relative to the floor at an angle of preferably between 10° and 40°.

The use the apparatus 10 with the user's stomach resting against the surface 38 is shown in FIG. 2. The upper tube 24*b* is first extended from the lower tube 24*a* so that both handle grips 42*a*,42*b* are moved to a position where they may both be grasped with the user assuming an outstretched position, with his hands extending upwardly above his head. The user stands upon the base 12 with each foot resting on the tube 18 straddling the support 14. The user then leans forward placing his weight upon the upper surface 38 of the support 14 and assumes an outstretched position by grasping the handle grip 42*a* with his right hand and handle grip 42*b* with his left hand.

The apparatus 10 is then operated by rotating the handle assembly 16 in opposite directions indicated by arrows 50,52,54,56 shown in FIG. 1. With the right hand, the user first pulls on the handle grip 42*a* against a resistive force applied by the user's left hand on handle grip 42*b*, thereby rotating the handle grip 42*a* in a first direction of arrow 50 downwardly towards the user along an arcuate path centered on pin 44. As the grip 42*a* moves in the first direction, the grip 42*b* moves in a second opposite direction of arrow 52 away from the user. The pulling force applied by the user's right hand contracts various muscles along the right half of the user's upper body, while the movement of the grip 42*b* away from the user stretches various muscles along the left half of the user's body.

The user next pulls the handle grip 42*b* in a second direction downwardly towards the user, causing the handle grip 42*b* to return along its arcuate path in the direction of arrow 54 and the handle grip 42*a* to return along its arcuate path in the direction of arrow 56 as shown in phantom in FIG. 1. In this movement, the user applies a countering force with his right hand on the grip 42*a* to provide resistance. The movement of the handle grip 42*b* towards the user, producing a contraction of various muscles along the left side of the user's torso, while the return movement of handle grip 42*a*, stretches muscle groups on the user's right side.

It has been found that with the foregoing configuration, the apparatus 10 may advantageously be used to exercise and/or stretch the user's muscles in the upper and lower back, as well as the shoulder areas, the upper and lower spine and basically all other upper body regions. In particular, the inclined position of the user on the support 14, and the rotational mounting of the handle assembly 16 on the upper surface 38 of the support ensures that the handle grips 42*a*,42*b*, and thus the user's hands, move in a plane which is substantially at right angles to sagittal plane of the user's body. This movement is thus advantageous in stretching and/or exercising most of the major muscle groups of the user's upper body, including Trapezius, Deltoid, Triceps brachii, Biceps brachii, Teres minor, Teres major, Latissimus dorsi, Deltoid, Transversus abdominis, Levator scapulai, Rhomboideus minor, Rhomboideus major, Latissimus dorsi, Longissimus thoracis and External intercostal.

In addition, the relatively large diameter and cylindrical construction of the tube 18, although not essential, is highly preferred, as it enables the user to stretch his or her leg muscles as well as the spine. For example, the user may place the ball of his feet on the tube 18 and lower his toes and/or heels towards the floor 20 to stretch the calves, Gastrocnemius, Soleus, Achilles tendon and Tibialis posterior. By the user dorsiflexing the feet by lowering his or her heels down to the floor in the manner shown in FIG. 2, there results increased intervertebral space in the user's spine. The increased intervertebral space reduces stress on nerves which may be impinged by vertebrate bones squeezing together, and thereby may reduce back pain.

As indicated, the possibility of adjusting the height of the support 14 enables the exercise apparatus 10 to be adjusted to optionally accommodate people of different heights, simply by removing the locking bolt 28, sliding the inner tube 24*b* upwardly or downwardly within the lower tube 24*a*, and reinserting the locking bolt 28 through aligned apertures 26,27. A further advantage of the telescoping construction of the support 14 is that the apparatus may be collapsed by sliding the tube 24*b* into the tube 24*a* for use with the user either sitting or kneeling on the base 12.

Figure 3:
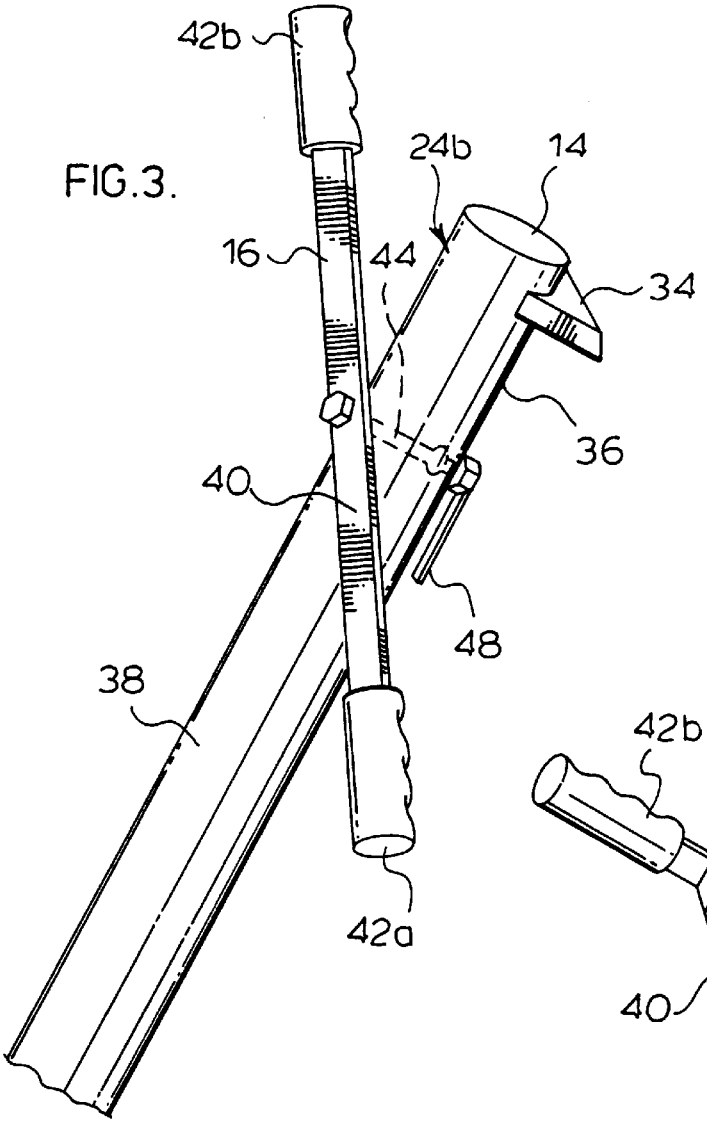
FIG. 3 shows a partial schematic view of a second embodiment of the handle assembly for use with the exercise device of FIG. 1.

While FIGS. 1 and 2 illustrate the handle assembly 16 as being pivotally coupled to the support 14 by a simple pin 44 attachment alone, modifications of this construction are also possible. FIG. 3 shows schematically a modified handle assembly 16 wherein like reference numerals are used to identify like components. The handle assembly 16 shown in FIG. 3 has essentially the same construction as handle assembly of FIG. 1, however, a tension adjusting lever 48 is provided coupled to the pin 44 along the lower surface 36 of the support 14. The lever 48 is threaded secured to one end of the pin 44 which extends outwardly beyond the lower surface 36. By turning lever 48, the bar 40 is tightened or loosened against the support 14. With this construction, resistance to the movement of the handle assembly 16 may be adjusted, and frictional forces restricting the handle assembly 16 rotation may be increased or decreased.

Where the tension adjusting lever 48 is provided, frictional forces are increased by turning the lever 48 to tighten the bar 40 against the upper surface 38, so that the handle assembly 16 no longer swivels freely relative to the support 14. In the use of the exercise device 10, the user therefore rotates the handle assembly 16 not only against the opposing force supplied by the user on the opposite handle grip, but also against the frictional forces applied by the lever 48.

Figure 4:
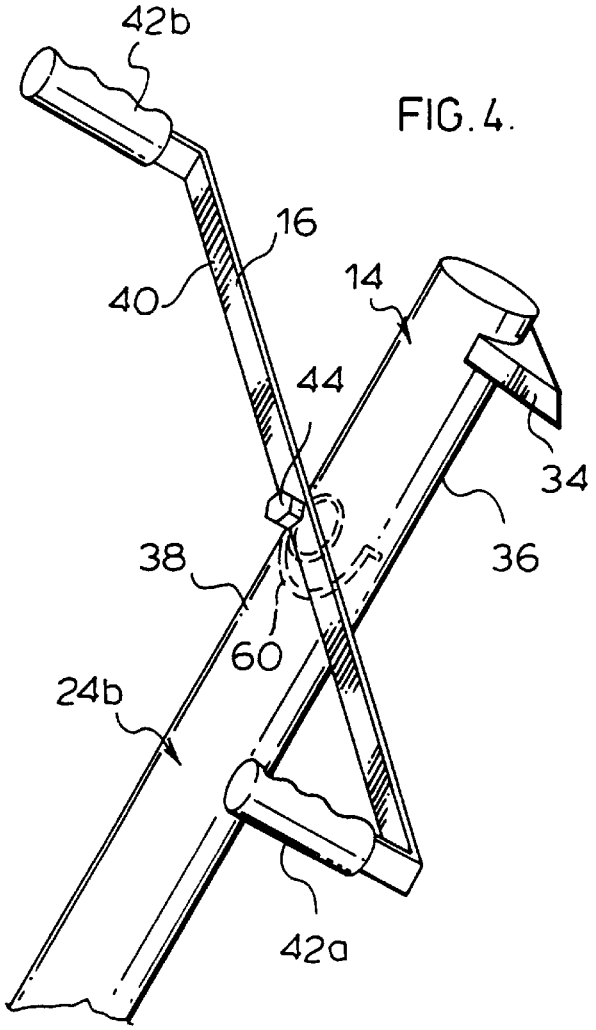
FIG. 4 shows a partial schematic view of a third embodiment of a handle assembly for use with the exercise device of FIG. 1.

FIG. 4 shows a further embodiment of a handle assembly for use in the present invention, wherein like reference numerals are used to identify like components. The handle assembly 16 of FIG. 4 is similar to that shown in FIG. 1, however, the handle grips 42*a*,42*b* extend perpendicularly from the bar 40, away from the support 14 and upper surface 38. Extending the ends of the handle assembly 16 away from the upper surface 38 of the support, enables the user to rotate the handle assembly 16 with the users hands and arms moving in a substantially coplanar relation with the frontal plane of the user's body.

In the embodiment shown in FIG. 4, the handle assembly is further rotated against the force of a coil spring 60 housed within the support 14. The spring 60 acts to resiliently return the handle assembly 16 to a rest position with the bar 40 positioned generally parallel to the axis $A_1$ of the tube 18 and the handle grips 42*a*,42*b* spaced an equal distance above the user. As the handle assembly 16 is rotated in either direction further away from the rest position, the force applied by the spring 50 increases against the direction of rotation. The force of the spring 60 thereby enhancing the exercise capabilities of the apparatus 10.

Although not shown, the apparatus 10 could equally include in combination the lever 48 of FIG. 3, as a tension adjusting mechanism, as well as the spring 60 of FIG. 4 to provide still further enhanced stretching and/or exercising characteristics.

Although a base 12 incorporating a cylindrical metal tube 18 is disclosed as being particularly advantageous as facilitating the stretching of the user's leg muscles, it is to be appreciated that other base constructions and materials such as plastics may also be used and will now become apparent. Similarly, while the preferred embodiment of the invention discloses the lower tube 24*a* as being welded to the base 12, other means of coupling the support 14 to the base 12 are also possible, including but not limited to mounting brackets and the like.

A tubular support 14 and elongate handle assembly 16 provide a simplified construction, however, it is to be appreciated that other more elaborate support constructions are also possible and will now become apparent. If desired, the apparatus 10 may further be modified so that the upper surface 38 of the body support 14 is provided with padding and/or a flat bench surface (not shown) for enhanced comfort and support to a user inclined thereon.

While FIG. 1 and 2 show a locking pin 28 and apertures 26,27 as the mechanism by which the tubes 24*a*,24*b* are secured in place, other locking mechanisms are also possible. FIGS. 5 and 6 show a further embodiment of the invention wherein like reference numerals are used to identify like components. In FIGS. 5 and 6, a clamp mechanism 56 is provided which permits infinite positioning of the tube 24*b* relative to the tube 24*a*. The clamp mechanism 56 consists of a resilient rubber or plastic split ring 58 having an inner radial diameter sized to fit about the tube 24*b*, and an outer radial diameter larger than the diameter of tube 24*a*. As seen best in FIG. 6, the ring 58 is split along a radial portion of its circumference with radially outwardly projecting tabs 60*a*,60*b* secured to each open end of the ring 58. The ring 58 is secured to the tube 24*b* by tightening a threaded screw knob 62 which is inserted in threaded bores (not shown) formed through each of the tabs 60*a*,60*b*. By turning the knob 62, the ends of the ring 58 may be brought together to bring the radially inner surface of the ring 58 into engagement with the tube 24*b*. When the mechanism 56 is secured in place on the tube 24*b*, the larger outer radial diameter of the ring 58 abuts against the uppermost end of the tube 24*a* to prevent further downward sliding of the tube 24*b* into tube 24*a*. It is to be appreciated that the clamping mechanism 56 shown advantageously avoids the need to form apertures 26,27 in the support 14, and thereby provides a further simplified construction of the apparatus 10.

FIG. 1 shows an apparatus having a base 12 and support 14 formed from cylindrical tubes, however, the invention is not so limited. FIG. 7 shows a partially exploded perspective view of one possible alternate construction wherein the base and support tubes are formed from hollow lengths of rectangular steel having a generally square cross-section.

The base 12 and support 14 of the apparatus 10 shown in FIG. 7 are essentially the same as that shown in FIG. 1 with like reference numerals used to identify like components.

The lower tube 24*a* is formed having a length of about 48 inches and a cross-sectional dimension of about 3.25 by 3.25 inches. The upper tube 24*b* is formed having approximately the same length as tube 24*a* and a slightly smaller cross-sectional dimension selected to permit its sliding insertion in the upper end of the tube 24*a*. A number of holes 26 formed through the sides of the tube 24*b* at 2 inch spaced intervals are sized to receive therein sliding insertion of a locking pin 28'. The insertion of the locking pin 28' into the holes 26 acts to adjust the height of the handle assembly 16, by its abutment with the upper edge of the tube 24*a* to prevent further sliding movement of the tube 26*b* downwardly into tube 26*a*.

The handle assembly 16 is rotatably secured to the upper surface 38 of the tube 24*b* in the same manner as described with reference to FIG. 1. The handle assembly 16 includes a straight metal bar 24 about 20 inches in length and which extends to an integrally formed handle grip 42*a*,42*b* at each of its ends. The handle grips 42*a*,42*b* are each about 5 inches in length and angle downwardly at an angle of about 45° relative to the bar 40. The bar 40 is rotatably coupled to the tube 24*b* at its mid point by a pin 44 which is inserted through the upper end of tube 24*b*.

Although the detailed description describes preferred embodiments of the invention, the invention is not so limited. Many modifications will now occur to persons skilled in this art. For a definition of the invention, reference may be had to the appended claims.

We claim:

1. An exercise apparatus for exercising a user's torso, wherein the exercise apparatus is used in an inclined position against a wall, the apparatus comprising:

support means for resting a user's torso thereon in an inclined position relative to a floor, wherein the user's torso rests against an inclined upper surface of the support means, a brace member for bracing said support means in said inclined position with said brace member engaging the wall, handle means comprising an elongated bar and having first and second ends for gripping by said user, the handle means pivotally coupled to the upper surface of the support means at a pivot point located above said user's torso, whereby rotational movement of said handle means moves said first end in a first direction along a first arcuate path and said second end in a second substantially opposite direction along a second arcuate path, said first and second arcuate paths each centered on said pivot point.

2. The exercise apparatus as claimed in claim 1 wherein said support means has a length selected so that when said user grips said first and second ends said user is supported in said inclined position in an outstretched position.

3. The apparatus as claimed in claim 2 wherein said apparatus further includes a lowermost base member coupled to said support means, said base member supporting a lowermost end of said support means and comprising a generally cylindrical tube having a longitudinal axis extending in a direction generally perpendicular to said support means.

4. The apparatus as claimed in claim 2 wherein said support means is adjustable in length.

5. The apparatus as claimed in claim 2 wherein said handle assembly is movable from a first rest position to a second position rotated relative to said first position, said apparatus further including biasing means for resiliently biasing said handle assembly to return to said first position.

6. The apparatus as claimed in claim 2 further including tension adjusting means for adjusting the resistance to rotational movement of said handle means, said tension adjusting means being adjustable to selectively increase or decrease said resistance.

7. A floor mounted exercise apparatus for exercising a user's upper body, wherein the exercise apparatus is used in an inclined position against a wall, the apparatus comprising:

an elongate body support member having a lower end, an upper end and an inclined upper surface for supporting said user's body resting against the body support member in an inclined position with respect to the floor, wherein said upper end includes a brace, wherein the brace is used for bracing said body support member against the wall, elongated handle means rotatably coupled to the upper surface at a pivot point spaced towards said upper end, the handle means having a first end and a second opposite end for gripping by said user, each of said first and second ends spaced from said pivot point whereby rotation of said handle means moves said first end in a first direction along a first arcuate path and said second end in a second direction generally opposite to said first direction along a second arcuate path, each of said first and second arcuate paths being centered on said pivot point, lowermost base member coupled to said support means, wherein said base member supports the lower end of said support means and comprises a generally cylindrical tube having a longitudinal axis extending in a direction generally perpendicular to said support means, and at least one shoe, coupled to either end of the base member, wherein the shoe limits sliding movement of the exercise apparatus along the floor and stabilizes the exercise apparatus in an inclined position relative to the floor.

8. The apparatus as claimed in claim 6 wherein said body support member has a length selected so that said pivot point is positioned above said user's upper body.

9. The apparatus as claimed in claim 6 wherein said body support member is adjustable in length.

10. The apparatus as claimed in claim 8 wherein said handle assembly is movable from a first rest position to a second position rotated relative to said first position, said apparatus further including biasing means for resiliently biasing said handle assembly to return to said first position.

11. The apparatus as claimed in claim 8 further including tension adjusting means for adjusting the resistance of rotational movement of said handle means.

12. The apparatus as claimed in claim 9 wherein the first and second ends of said handle means are rotatably movable in a plane substantially parallel to a frontal plane of said user when said user is supported in the inclined position.

13. The apparatus as claimed in claim 10 wherein said upper surface of said body support member is inclined at an angle between 10° and 40° with respect to the floor.

14. The apparatus as claimed in claim 13 wherein the first and second ends of said handle assembly move in a plane substantially parallel to a frontal plane of said user when said user is supported in the inclined position.

15. A method for using a floor mounted exercise apparatus for exercising a user's upper body, wherein the exercise apparatus is used in an inclined position against a wall, said method comprising:

bracing the floor mounted exercise apparatus in an inclined position with respect to the floor by using a brace member, attachable to a body support member, to engage the wall, resting the user's body on the body support member, wherein the body support member includes a lower end and an upper end extending above said user, and an inclined upper surface for supporting said user thereon in a position inclined relative to said floor, grasping an elongated handle means having a first end and a second opposite end, the handle means rotatably coupled to the support member at a pivot point spaced towards the upper end so that when said user grasps said first and second ends in said inclined position, said user is in a substantially outstretched position, rotating said handle means by moving said first end in a first direction along a first arcuate path toward said user and then moving said second end in a second direction along a second arcuate path toward said user, said first and second arcuate paths each being centered on said pivot point.

16. The method for using an exercise apparatus as claimed in claim 15 wherein the rotating step causes the first and second ends of said handle assembly to move in a plane substantially parallel to a frontal plane of said user supported in said inclined position.

17. The exercise apparatus as claimed in claim 3 further comprising:

shoe means, coupled to each end of the lowermost base member, for limiting sliding movement of the exercise apparatus along the floor and for stabilizing the exercise apparatus in an inclined position relative to the floor.

18. The exercise apparatus as claimed in claim 1 wherein the handle means further comprises handle grips extending perpendicularly from the handle means away from the body support member such that when the handle means is rotated, the user's hands and arms move in a substantially coplanar relation with a frontal plane of the user's upper body.

19. The exercise apparatus as claimed in claim 1 wherein said body support means has a length selected so that when said user grips said first and second ends said user is supported in said inclined position in one of a sitting and a kneeling position.

* * * * *